US007225771B2

(12) United States Patent
Hedman

(10) Patent No.: US 7,225,771 B2
(45) Date of Patent: Jun. 5, 2007

(54) METHOD AND DEVICE FOR PRESSURE PULSE GENERATION

(75) Inventor: Mats Hedman, Båvensvik (SE)

(73) Assignee: Cargine Engineering AB, Helsingborg (SE)

( * ) Notice: Subject to any disclaimer, the term of this patent is extended or adjusted under 35 U.S.C. 154(b) by 15 days.

(21) Appl. No.: 10/515,921

(22) PCT Filed: May 22, 2003

(86) PCT No.: PCT/SE03/00826

§ 371 (c)(1),
(2), (4) Date: Aug. 19, 2005

(87) PCT Pub. No.: WO03/102385

PCT Pub. Date: Dec. 11, 2003

(65) Prior Publication Data

US 2006/0086328 A1 Apr. 27, 2006

(30) Foreign Application Priority Data

May 30, 2002 (SE) ..... 0201613

(51) Int. Cl.
*F01L 9/02* (2006.01)

(52) U.S. Cl. ..... 123/90.12; 123/90.14; 123/90.15; 251/129.03

(58) Field of Classification Search ..... 123/90.12, 123/90.14
See application file for complete search history.

(56) References Cited

U.S. PATENT DOCUMENTS 6,752,106 B2 * 6/2004 Hedman ..... 123/90.12
7,121,237 B2 * 10/2006 Hedman ..... 123/90.12

FOREIGN PATENT DOCUMENTS

WO 02/04790 1/2002

* cited by examiner

*Primary Examiner*—Thomas Denion
*Assistant Examiner*—Kyle M. Riddle
(74) *Attorney, Agent, or Firm*—Young & Thompson

(57) ABSTRACT

A device for generating pressure pulses, includes a pressure fluid source and a pressure fluid depression, a pressure fluid circuit, a valve body displaceably located in a chamber, a first branch and a second branch the branches leaving to opposite sides of the valve body, the chamber having an opening on one side of the valve body, the opening communicating with the first branch and permitting pressure fluid to flow out of the chamber. The valve body, under the action of the pressure fluid in the branches, is displaceable to a first position in which it closes the opening and to a second position in which it leaves the opening open for out-flow of the pressure fluid. The device includes a first valve member arranged to permit or interrupt communication between the chamber and the pressure fluid source through the second branch upstream of the chamber.

26 Claims, 10 Drawing Sheets

METHOD AND DEVICE FOR PRESSURE PULSE GENERATION

TECHNICAL FIELD

The present application relates to a method for controlling a pressure fluid flow in a pressure pulse generator.

The invention also relates to a device for generating pressure pulses.

The invention is applicable to all types of technical areas were pressure pulses are to be generated. In particular it is applicable to applications on which there are high requirements on the speed with which pulses can be generated and on the time period of the individual pulses.

Internal combustion engines define a field in which pressure pulses can be used for controlling and effecting the movements of the valves of the combustion engine instead of operating and controlling the movements of the inlet, outlet or fuel injection valves by means of a conventional transmission of the motion of the piston of the engine to the valves by means of a camshaft. The invention can also by used for controlling and operating a piston arranged for the purpose of achieving a variable compression in a combustion engine cylinder.

Accordingly, the invention will, by way of example, and not in a delimiting purpose, be described with reference to the application in which it is used for the control of and operation of the inlet or outlet valves of the combustion chamber of a combustion engine.

THE BACKGROUND OF THE INVENTION

Since a number of years designers of piston combustion engines have seen a need of being able to vary the valve times during engine operation, since this would result in great advantages with regard to, for example, fuel economy and emissions.

Therefore, extensive efforts have been made in order to replace conventional camshaft systems for the opening and closure of engine valves by systems that are based on the use of electromagnetism for controlling and operating the valves of the engine. The disadvantage of such solutions is that the high requirements on the speed by which the valves can be operated will result in high requirements on the electromagnets that are used. The mass that each electromagnet has to bring into motion corresponds to the mass of the valve. The valve must comprise a suitable magnetic material in order to be displaced by the action of one or more electromagnets, and such materials contribute to an increase of the mass of conventional valves. This often results in an evil circle in which an improvement of a valve from a magnetic point of view will result in a weight increase that, in its turn, results in a need of larger and more powerful electromagnets. Accordingly, in this way, it will be difficult to achieve an economically and practically good solution to obtaining a sufficiently fast control and operation of the valves of the engine. Moreover, it is well known that electromagnets will require a certain time for magnetising and demagnetising.

There are also efforts being made to obtain the requested movements of the engine valves by means of hydraulics. Today, such systems are tested by, amongst others, vehicle manufactures. The pressure fluid, here the hydraulic liquid, is in this case used in order to effect the engine valve movement. Thereby, it is required that the pressure pulse generator that is used has an ability to deliver the pressure pulses that cause the valve movements rapidly and with high precision. The present inventor does not know any pressure pulse generator according to prior art that has the performance required to satisfyingly cope with the valve control at the rotations per minute of the engine that are used today in two-stroke, and, in particular, four-stroke combustion engines. An obstacle to the accomplishing of such a pressure pulse generator may be the difficulty to achieve sufficiently rapid opening/closure movement of the valve or valves that is/are required in such a pressure pulse generator. Here, it should be mentioned that valves are often replaced by ports in modern two-stroke engine constructions, but that the present invention results in the possibility of using valve technology in two-stroke engines in a way corresponding to that of four-stroke engines.

In this context, it should also be mentioned that the pressure pulse generators that may come in question should be compact and occupy only a small space in combustion engine applications.

THE OBJECT OF THE INVENTION

One object of the present invention is to provide a method and a device that enable generation of pressure fluid pulses with very high frequency and precision.

A further object is to provide a method and a device that make it possible to deliver pressure pulses with high frequency and precision with maximum use of the pressure fluid, i.e. without any pressure fluid loses in the pressure fluid circuit or circuits.

A further object is to provide a method and a device that make it possible to, with so few and uncomplicated components as possible, in particular with as few electro magnets as possible, generate pressure pulses with high frequency and precision.

A further object of the invention is to provide a method and a device for pressure pulse generation that are applicable to combustion engines for controlling and operating individual inlet, outlet and injection valves (for fuel or water). The invention shall also be able to act as a driving apparatus for a piston for accomplishing a variable compression ratio in a combustion engine.

Another object is to provide a method and a device for pressure pulse generation, that create the conditions for or, in practice, permits a transition from two-stroke operation to four-stroke operation and vice versa in a combustion engine the valves of which are controlled by a device according to the invention that operates in accordance with the method according to the invention.

SUMMARY OF THE INVENTION

The main object of the invention is achieved by means of the initially defined method, having the features that are defined in the characterising portion of patent claim 1, and by means of a device as initially defined, having the features that are defined in the characterising portion of patent claim 12.

Preferred embodiments of the method that contributes to the achievement of the objects of the invention are defined in the dependent patent claims 2–11.

Preferred embodiments of the device that contribute to the achievement of the object of the invention are defined in the dependent claims 13–25.

Further features and advantages of the method and the device according to the invention will be seen from the following, detailed description.

BRIEF DESCRIPTION OF THE DRAWINGS

The invention shall now be described by way of example with reference to the annexed drawings on which.

DETAILED DESCRIPTION OF THE INVENTION

Figure 1:
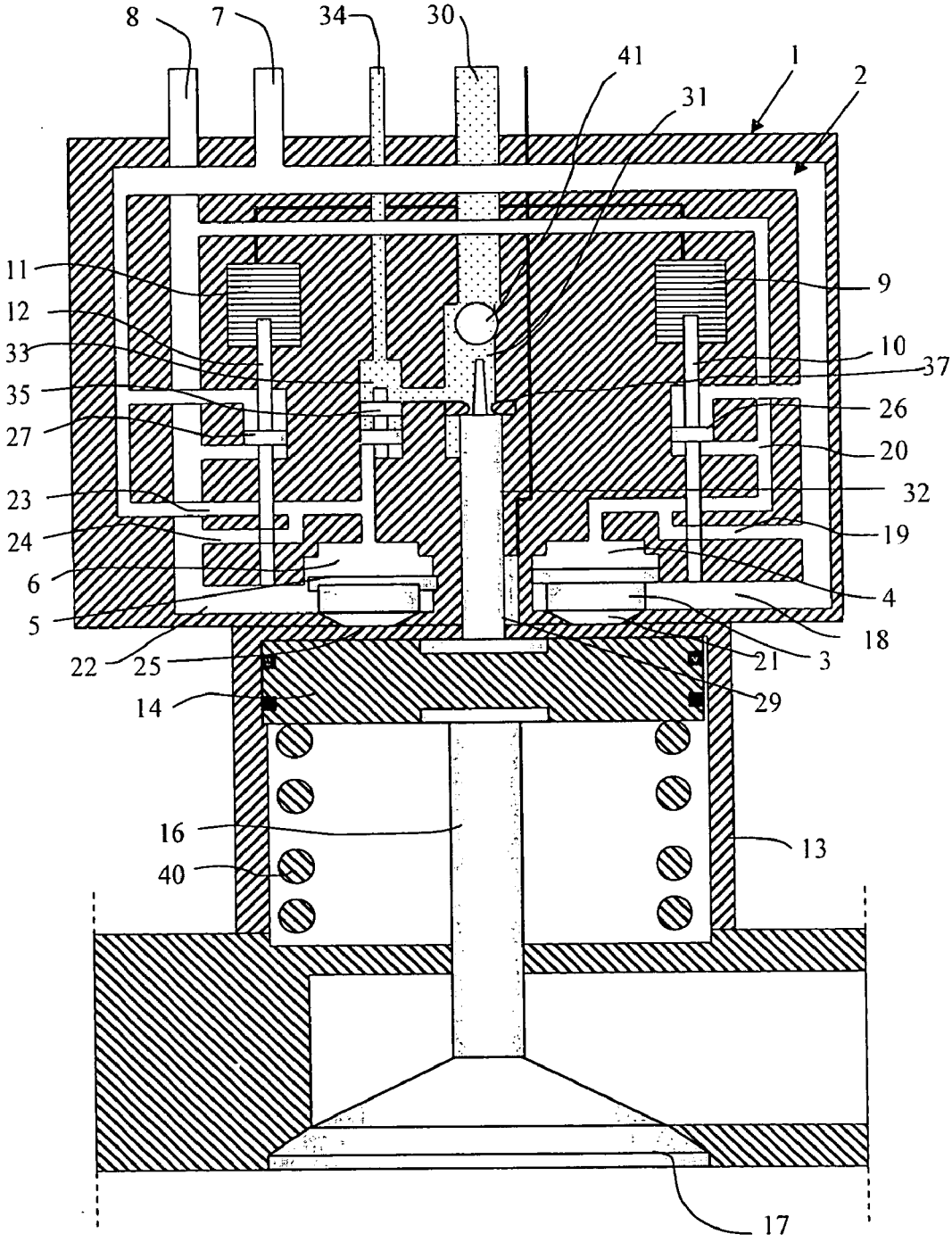
FIG. 1 is a diagram that shows a first embodiment of a device according to the invention, schematically and in cross section, in a start position.

FIG. 1 shows a first embodiment of a device according to the invention, the device being generally designated with 1 and comprising a pressure fluid circuit 2, a first valve body 3, which is positioned in a first chamber 4, a second valve body 5, which is positioned in a second chamber 6, a pressure fluid source 7, a pressure fluid depression 8, a first valve that comprises an electro magnet 9 and a third valve body 10 driven by said electro magnet, a second valve that comprises a second electro magnet 11 and a fourth valve body 12 driven by the latter.

Further, the device comprises a cylinder 13 and an actuator piston 14 which is displacebly arranged in the latter. The pressure fluid circuit 2 communicates with and is arranged to deliver pressure fluid pulses on one side of the piston 14, for the displacement of the latter. The piston 14 is, via a valve shaft 16, connected with a valve 17, to a combustion chamber of a combustion engine. The valve 17 could, however, as well be a valve for injection of fuel to the combustion chamber of a combustion engine or could be connected with or form a piston in a cylinder connected with the combustion chamber for the purposes of accomplishing a variable compression ratio, the position of the valve and variable compression piston respectively in relation to a cylinder of the combustion engine being controlled by the pressure fluid pulses.

Preferably, the pressure fluid is gaseous and, most preferably, it is constituted by air or carbon dioxide. In the applications referred to above, the pressure fluid source 7 is, preferably, a compressor with a tank associated thereto, or a pressure tank exclusively, associated to the combustion engine, and the pressure fluid depression is any site that has a lower pressure than the air pressure generated by the compressor or the pressure existing in the pressure tank.

The pressure fluid circuit 2 comprises a first branch 18 and a second branch 19, which branch off from the pressure fluid source 7 and extend to opposite sides of the first valve body 3 in the first chamber 4. From one of the sides of the first valve body 3 in the first chamber 4 a conduit 20 leads to the pressure fluid depression, and on the other side of the first valve body 3 there is an opening 21, the periphery of which forms a seat for the valve body 3, the first chamber, or the high pressure side of the pressure fluid circuit 2, being able to communicate with the cylinder chamber 15 through opening 21. The first branch communicates with a first chamber 4 on the side of the first valve body 3 where the opening 21 is located.

In the shown embodiment, a first chamber 4 is in constant communication with the pressure fluid source 7 branch 18 via the first branch.

The device 1 also comprises a third branch 22 and a fourth branch 23, which branch off from the pressure fluid depression 8 and pressure fluid source 7 respectively and extend to opposite sides of the second valve body 5 in the second chamber 6. A fifth branch 24 extends from the pressure fluid depression 8 to one side of the second valve body 5 in the second chamber 6, and on the other side of the second valve body 5 there is an opening the periphery of which forms a seat for the valve body 5, the second chamber, or the low pressure side of the pressure fluid circuit, being able to communicate with the cylinder chamber 15 through the opening 25.

The third branch communicates with the second chamber 6 on the side of the second valve body 5 where the opening 25 is located. That of the areas of the valve bodies 3 and 5 onto which the pressure fluid of the pressure fluid circuit acts in one direction, here the closure direction, is larger than the opposite area in chambers 4 and 6 on which the pressure fluid acts in the opposite direction, when valve bodies 3 and 5 rest against the periphery of the openings, i.e. a region or an edge around the openings 21, 25, and close the latter. Moreover, the surface that covers the opening 21, 25 is smaller than the first-mentioned area of each individual valve body. The valve bodies 3, 5 are designed as disk valves.

In the embodiment shown, the second chamber 6 is in constant communication with the pressure fluid depression 8 via the third branch 22.

The device comprises a first electrically activateable valve member for opening/interrupting of the communication between the first chamber 4 and the pressure fluid source 7, and a second electrically activateable valve member for the opening/interruption of the communication between the first chamber 4 and the pressure fluid depression via said conduit. The first and the second valve members are formed by the first electro magnet 9 and the valve body 10 driven by the latter, said valve body defining a decompressed slide valve. The first valve member is arranged to open when the second valve member closes and vice versa. This is achieved as the valve body 10 is a equipped with at least one channel or passage (not shown) that, upon activation of the electro magnet, is displaced in front of (an exact centring is not required but is preferred) of one of the conduit 20 or the second branch 19, and is displaced to a position in front of the other one of the conduit 20 and the branch 19 deactivation of the electro magnet 9.

The device comprises a spring element 26 for displacing the first valve body 10 when the electro magnet 9 is deactivated. This will be explained more in detail later.

According to the alternative embodiment shown in FIGS. 6–10, the device comprises a third valve member formed by the second electro magnet 11 and the valve body 12 associated thereto, said third valve member being provided for opening/interruption of the communication between the first chamber 4 and the pressure fluid depression 8 through the conduit 20. In this case, the third member is located upstream the second valve member. Upon activation of the second electro magnet 11, the third valve member opens for communication in the conduit 20, and upon deactivation of the electromagnet said valve member interrupts the communications.

The device, according to all the embodiments shown, further comprises a fourth valve member formed by the second electro magnet 11 and the valve body 12 associated thereto, the fourth valve member being arranged for opening/interruption of the communication between the pressure fluid source 7 and the second chamber 6 through the fourth branch 23. Furthermore, the device comprises a fifth valve member formed by the second electro magnet 11 and the valve body 12 associated thereto, said fifth valve member being arranged for opening/interrupting the communication between the second chamber 6 and the pressure fluid depression 8. The fourth valve member is arranged to open when the fifth valve member interrupts and vice versa. This can be achieved by letting the valve body 12 comprise at least one channel or opening that, upon activation of the second electro magnet 11, is displaced to a position opposite to one of the fourth branch 23 and the fifth branch 24, and, upon deactivation of the same is displaced to a position in which it is located opposite to the second one of the fourth and fifth branch 23, 24.

In the embodiments according to FIGS. 7–10, the third valve member is arranged to open in the conduit 20 when the fourth valve member opens for communication between the pressure fluid source 7 and the second chamber 6 through the fourth branch 23, that is when the fourth member closes for communication between the pressure fluid depression 8 and the second chamber through the fifth branch 24.

The device comprises a spring element 27 for displacing the second valve body 12 when the second electro magnet 11 is deactivated. This will be explained more in detail later.

Figure 9:
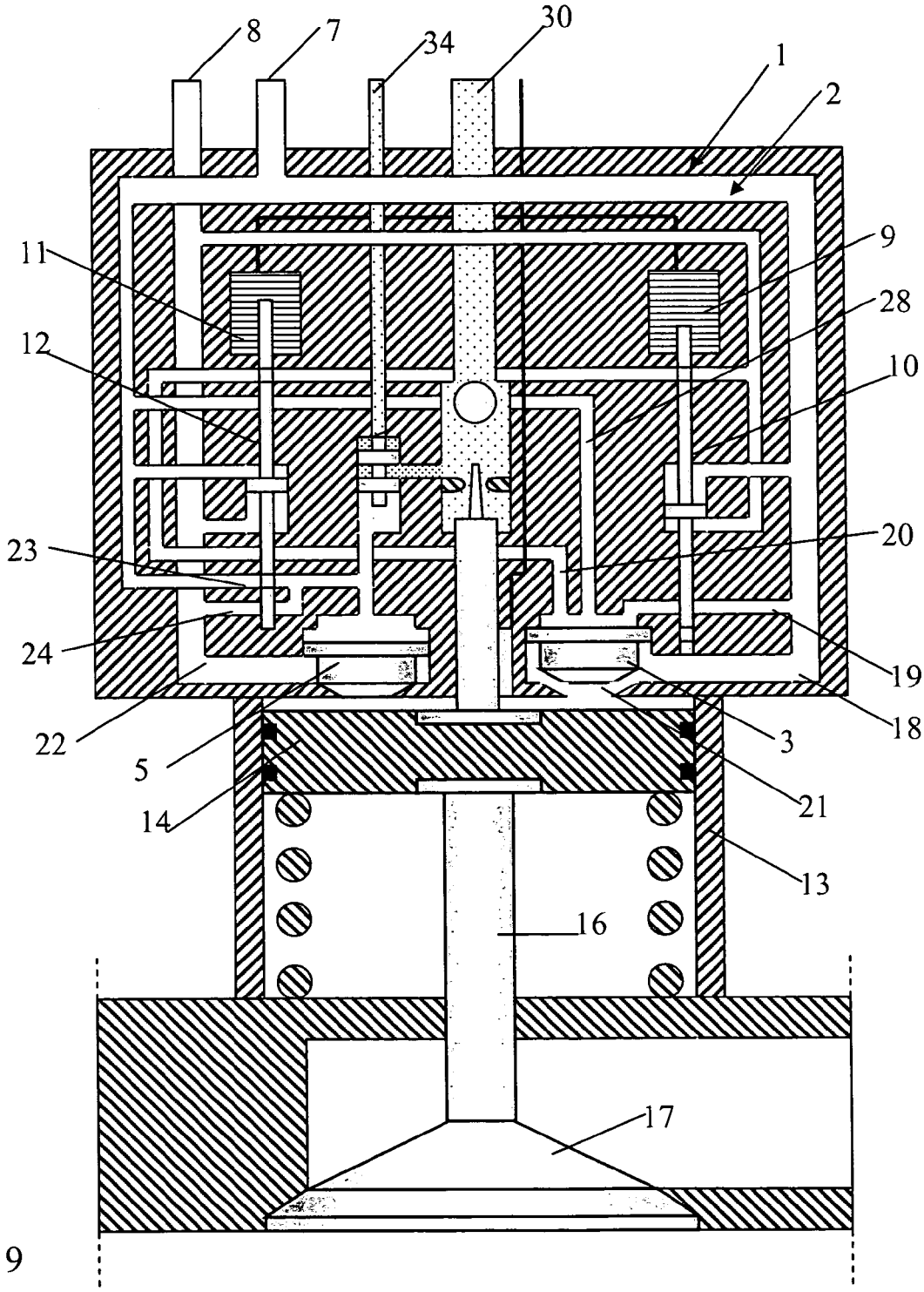
FIG. 9 shows a third embodiment of the device according to the invention, in a first stage.
Figure 10:
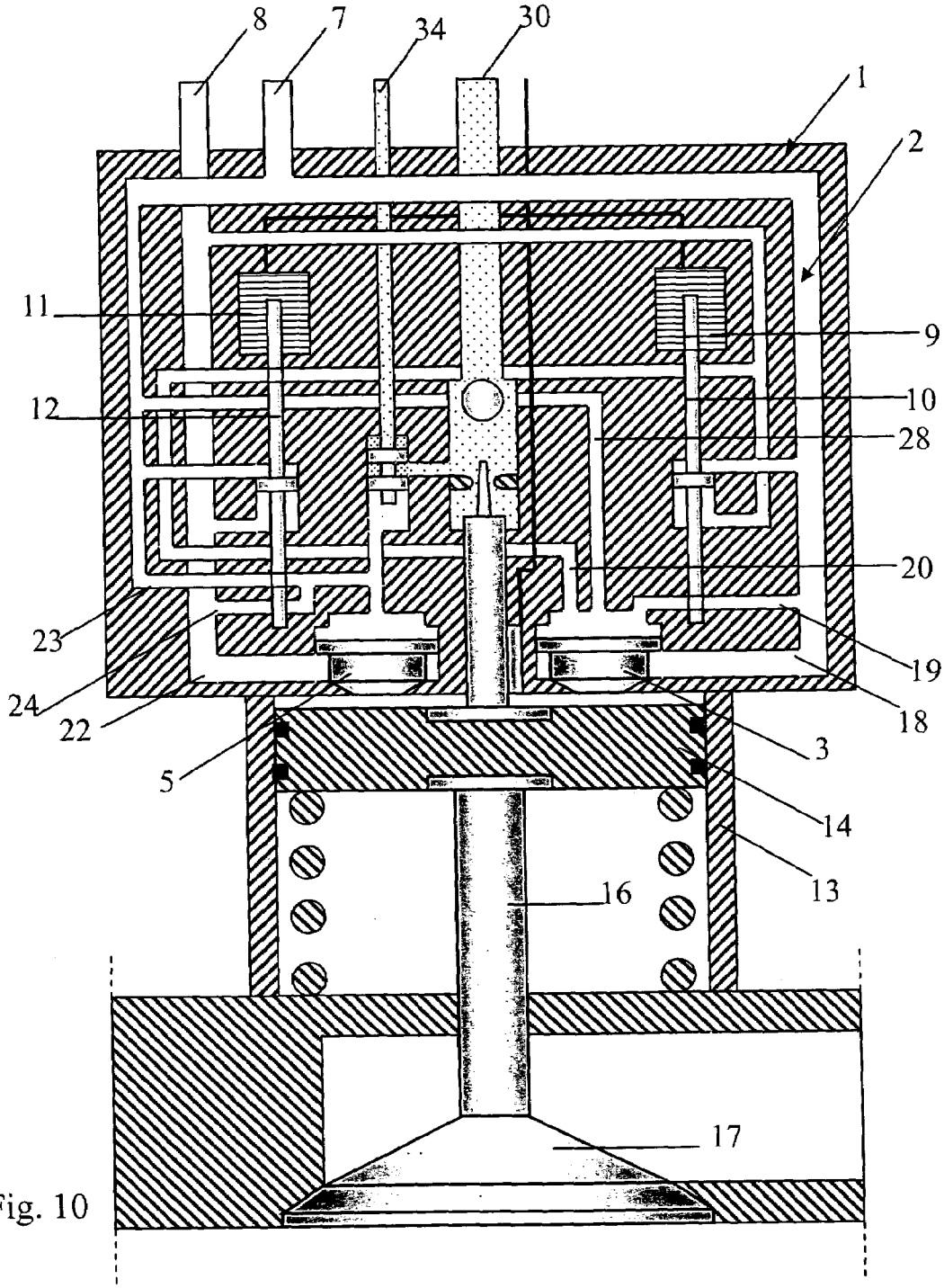
FIG. 10 shows the device according to FIG. 9 in a second stage.

In the third embodiment that is shown in FIGS. 9 and 10, the device comprises a sixth branch 28, through which the first chamber 4 communicates with the pressure fluid source 7, and a sixth valve member, formed by the second electro magnet 11 and the valve body 12 associated thereto, for the purpose of enabling and interrupting the communication between the first chamber 4 and the pressure fluid source 7 through the sixth branch 28. The sixth valve member is arranged to open when the fifth valve member opens, i.e. when the fourth valve member closes.

Further, the device comprises a sensor 29, for example an optical or inductive sensor, which registers the position of the actuator piston 16 or any part connected thereto. The sensor 29 is operatively connected with a control unit (not shown) that, based on the signal from the sensor, activates or deactivates the first and the second electro magnet 9, 11. Furthermore, the device comprises a sensor (not shown) for sensing the position of that cylinder of a combustion engine to which the valve actuator is associated. The control unit, which is also operatively connected with this sensor, may then be arranged to control the electro magnets 9, 11 based on the information from this sensor.

As has been mentioned earlier, the device comprises spring elements 26, 27 that act for a redisplacement of the valve bodies 10, 12 that have been displaced when the electro magnets 9, 11 have been deactivated, that is when the latter let the valve bodies 10, 12 loose. In this case, the spring elements 26, 27 are pressure fluid regulated as one surface of the valve bodies 10, 12 associated thereto can communicate through a branch or a conduit, in this case constantly, with pressure fluid source 7, and a second, opposite surface can communicate through a further branch or conduit, in this case constantly, with the pressure fluid depression 8. The high pressure side is, in this case, arranged to counteract the electro magnet and redisplace the valve body 10, 12 upon said deactivation. It is also conceivable that one of the surfaces communicates with the atmosphere and that the other surface communicates with the pressure fluid depression, given that the latter has a higher pressure than the atmosphere pressure (we assume that the surfaces are equally large).

Apart from the components already mentioned, the device preferably comprises at least one hydraulic brake and locking arrangement, that comprises a hydraulic circuit that consists of a conduit 30 that runs from a pressure source (not shown), which for example may comprise the oil pump of a combustion engine, to a chamber 31, in which a piston shaft 32 connected with actuator piston 16 penetrate at least some time during the displacement of the actuator piston, preferably when the inlet valve 17 associated to the latter reaches a home position in which it is positioned in its seat in the cylinder top. The device has a valve, preferably a non return valve 41, that opens for communication between the liquid source and the chamber 31 through the hydraulic liquid conduit 30 and closes in the opposite direction. Furthermore, there is a down stream conduit 33 through which the chamber 31 can communicate with a low pressure side 34 in the hydraulic circuit, for example the oil pan of a combustion engine.

The chamber 31 comprises a constriction 37, through which the piston shaft 32 will move, the constriction 37 or the piston shaft being arranged in such a way that a slot is generated between them, said slot being reduced during said motion. For example, this is achieved by, as here, the end of the piston shaft 32 being conical. In that way, an increasing braking effect is achieved in said direction as the liquid that is forced away by the piston shaft 32 in the chamber 31 get an increasingly small slot for its removal as the piston motion continues. The hydraulic liquid that is heated during the braking is thereby transported away through the downstream conduit 33.

The device comprises an activatable valve 35 for opening/interruption of the communication through the downstream hydraulic liquid conduit 33. The valve 35 forms a decompressed slave valve and is, through a seventh branch 36, connected with the second chamber 6, or with the fourth branch and fifth branch that for the moment opens for pressure fluid communication between the second chamber and pressure fluid source or pressure fluid depression respectively. The pressure fluid in the seventh branch 36 acts against the surface of the valve 35 for the purpose of displacing the latter in a direction towards a position in which it closes. On an opposite surface there is a counter force, in this case constituted by the hydraulic liquid in the downstream hydraulic liquid conduit 33, for the purpose of displacing the valve to a position in which it closes, i.e. interrupts, the communication with the downstream conduit 33. The pressures and areas of the surfaces that are effected by pressure fluid and the pressure liquid respectively are adapted in such a way the slave valve 35 opens for communication through the conduit 33 when the seventh branch 36 communicates with the pressure fluid depression 8, and closes said conduit 33 when the seventh branch 36 communicates with the pressure fluid source 7.

A cycle of the device according to the invention according to a first embodiment will now be explained with reference to, primarily, FIGS. 1–5.

In FIG. 1, the device is shown in a starting position in which the two electro magnets 9, 11 and the valve bodies 10, 12 associated thereto are deactivated, whereby the engine valve 17 is in its home position, in which it rests against its seat. The pressure fluid source 7 communicates with the first chamber 4 on both sides of the first valve body 3, and since the side of the body 3 that is directed away from the opening 21 is larger than the area of the opposite side the valve is closed. In a corresponding way, the pressure fluid depression communicates with the second chamber 6 on both sides of the second body 5, which, accordingly, closes the opening 25 associated thereto.

Figure 2:
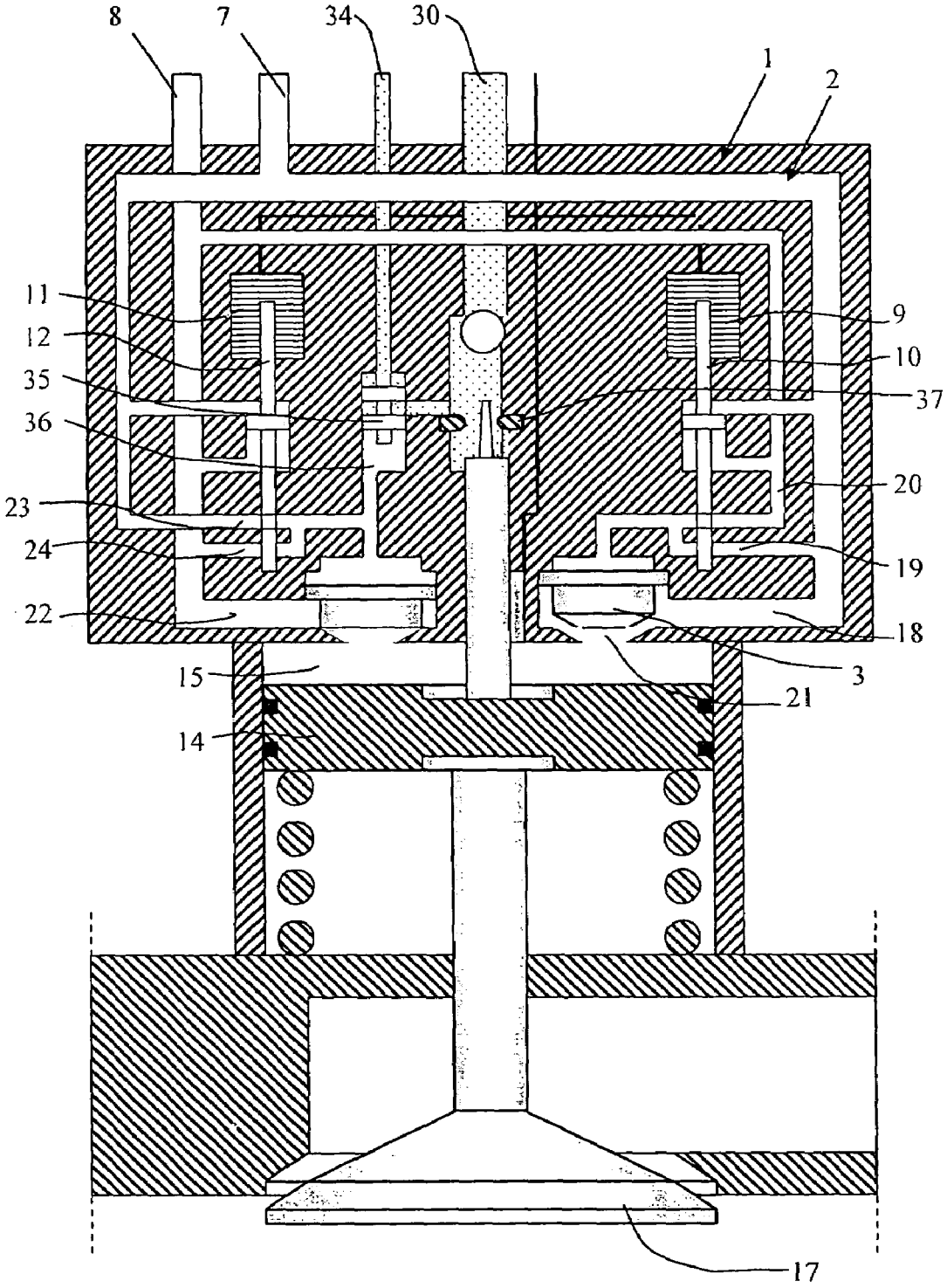
FIG. 2 is a diagram corresponding to the one of FIG. 1, but with the device shown during a first stage.

In FIG. 2, the device is shown in a position just after that the first electro magnet 9 has been activated following an order from a control unit based on a sensor measurement of the position of the piston in the combustion engine cylinder in question. As a result of the activation of the first electro magnet 9, the first valve body 10, interrupts the communication between the first chamber 4 and the pressure fluid source 7 through the second branch. The pressure by which the pressure fluid acts on the first valve body 3 through the first branch makes the valve body move away from the opening 21 and, thereby, permits pressure fluid to flow into the chamber 15 and, thereby, displace the actuator piston 14 and the valve 17 from the home position. The displacement of the valve from the home position takes places, in a conventional way, against the action of a valve spring 40.

Also the second electro magnet 11 has been activated and, thereby, permits a communication between the pressure fluid source 7 and the second chamber 6 through the fourth branch 23. Thereby, the second valve body 5 is prevented from being displaced from the opening 25 associated thereto, which would result in the fluid being able to flow from the chamber 15 through said opening 25.

Figure 3:
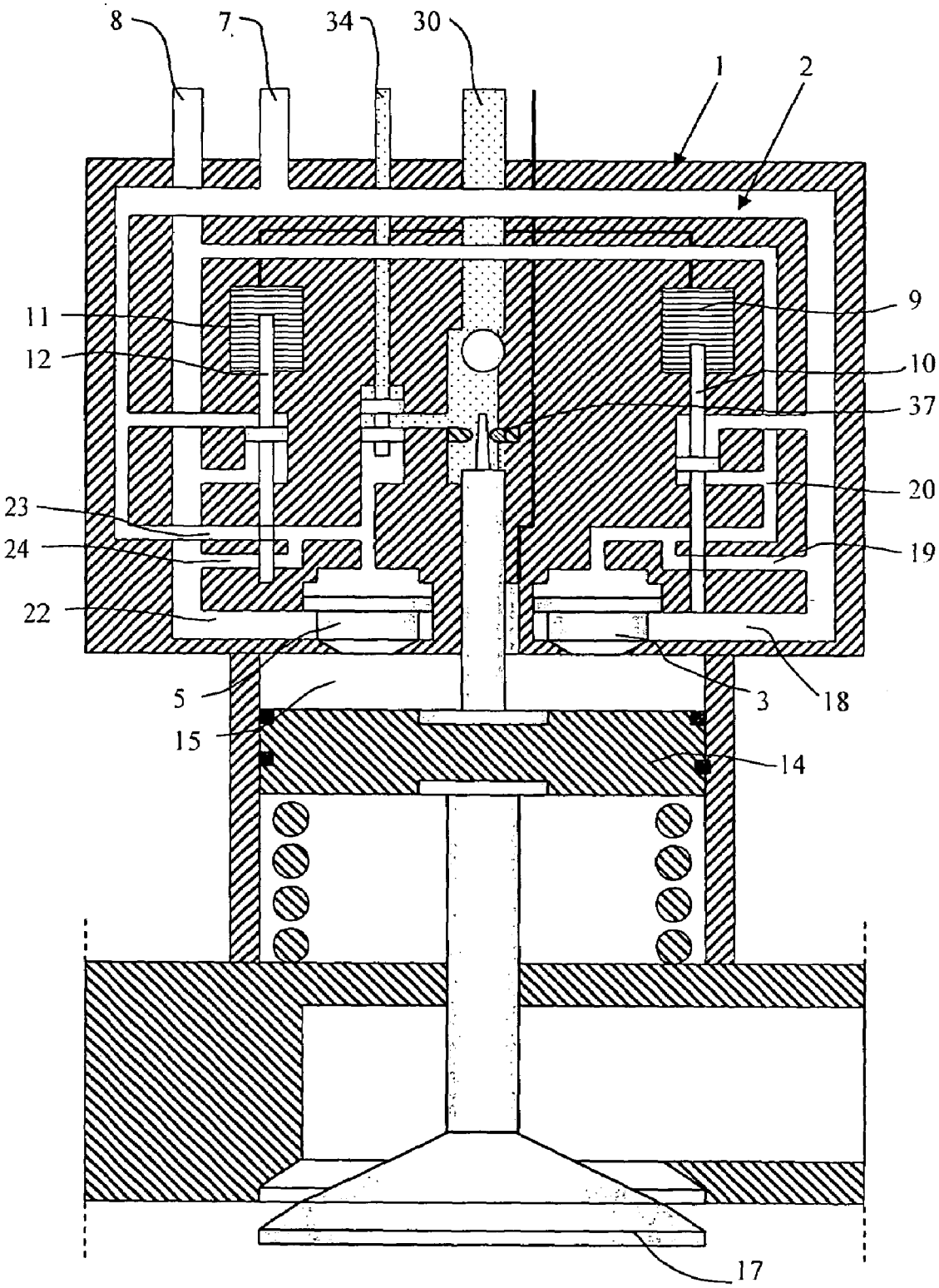
FIG. 3 shows the device according to FIGS. 1 and 2 during the end of the first step.

In FIG. 3 there is shown a subsequent stage, during which the first electro magnet 9 has been deactivated and the valve body 10 associated thereto has been redisplaced to its starting position through the action of the spring element 26. The first valve member is once again open for communication between the first chamber 4 and the pressure fluid source 7 through the second branch 19, resulting in the first valve body 3, which is located in the first chamber, having been redisplaced to a position in which it closes the first opening 21. Due to the continued expansion of the pressure fluid in the chamber 15, and to the kinetic energy of the displaced mass, the motion of the actuator piston 14 and the valve 17 continues a bit further.

It should be noted that the slave valve 35, through the seventh branch 36 and through the fourth branch 23, communicates with the pressure fluid source 7, thereby interrupting any evacuation of hydraulic liquid through the downstream conduit 33, but that an inflow through the upstream conduit 30 is permitted. This results in the hydraulic circuit being able to act as a lock when the valve 17 reaches its remote position or lower dead, up to the point when the slave valve 35 is once again brought to its opening position.

Figure 4:
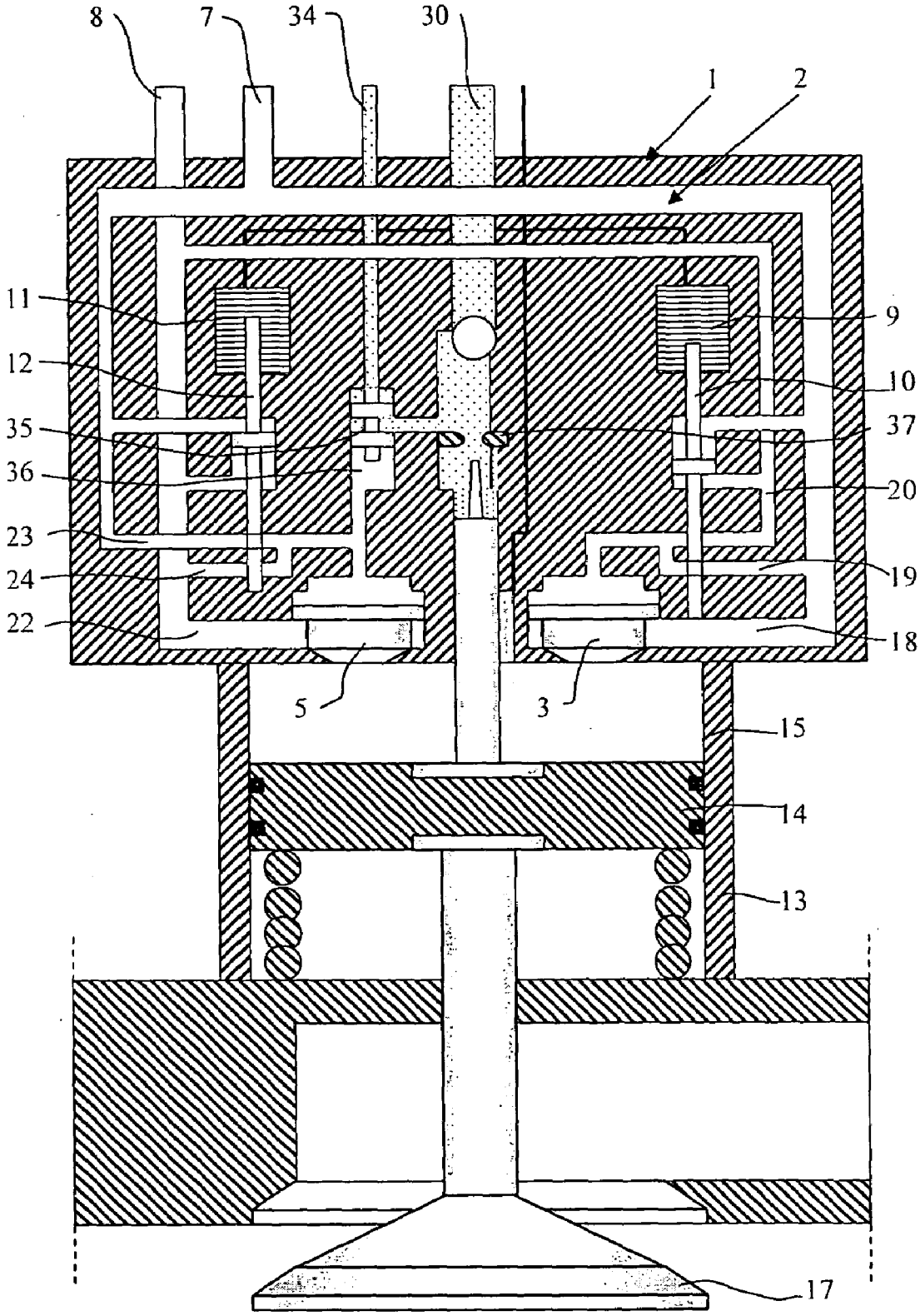
FIG. 4 shows the device according to FIGS. 1–3 during a continued motion.

In FIG. 4, only the continued motion of the actuator piston 14 and the valve 17 associated thereto towards the remote position is shown, the valve possibly being temporarily locked before the deactivation of the second electro magnet.

Figure 5:
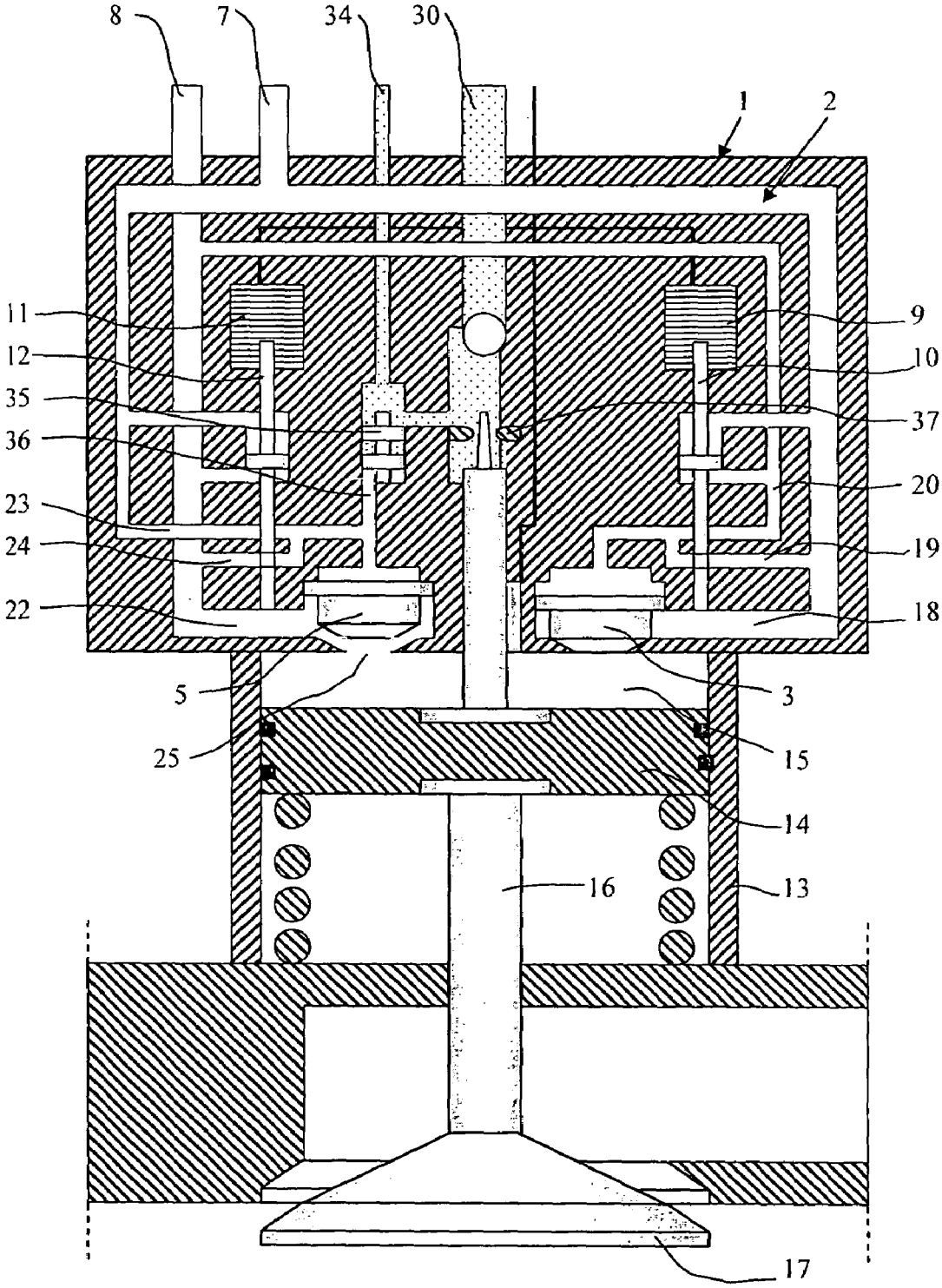
FIG. 5 shows the device according to FIGS. 1–4 during a second stage.
Figure 6:
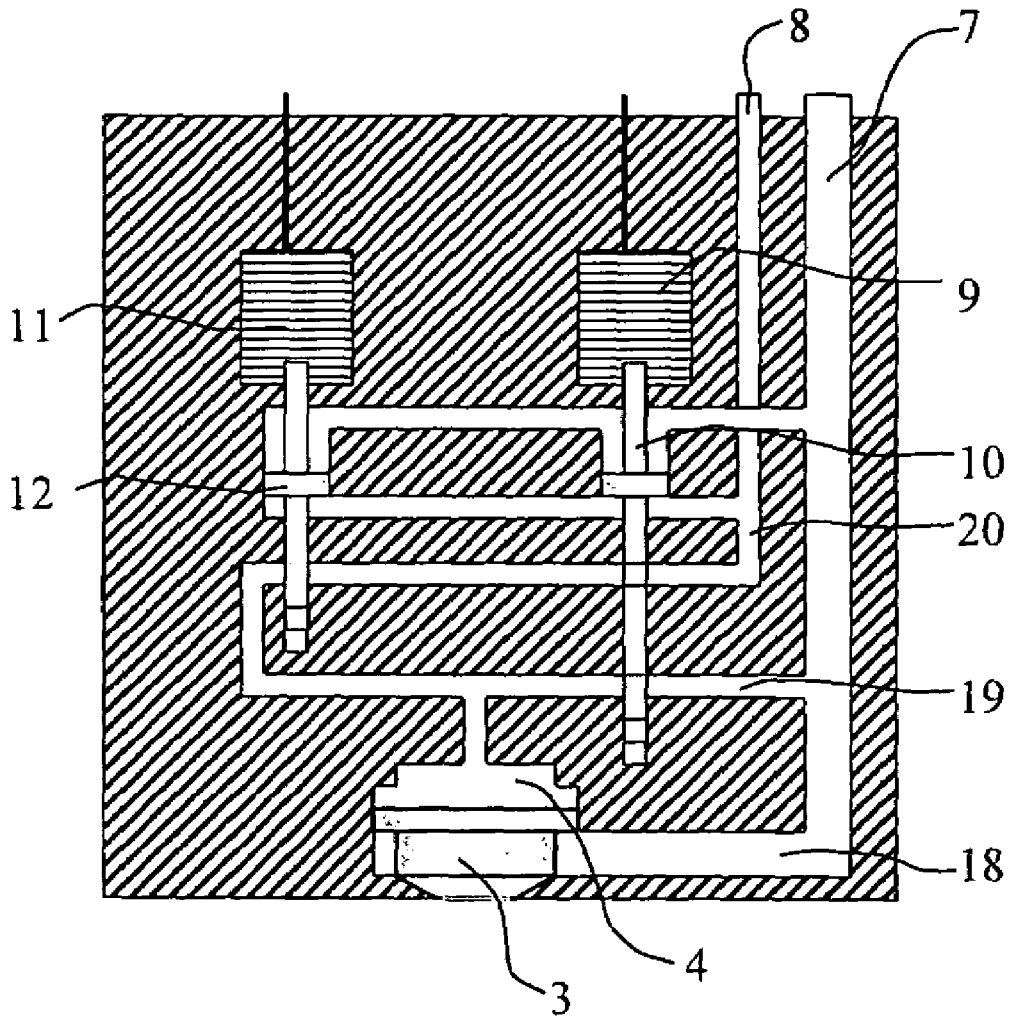
FIG. 6 shows an alternative embodiment of a part of a circuit of the inventive device.
Figure 7:
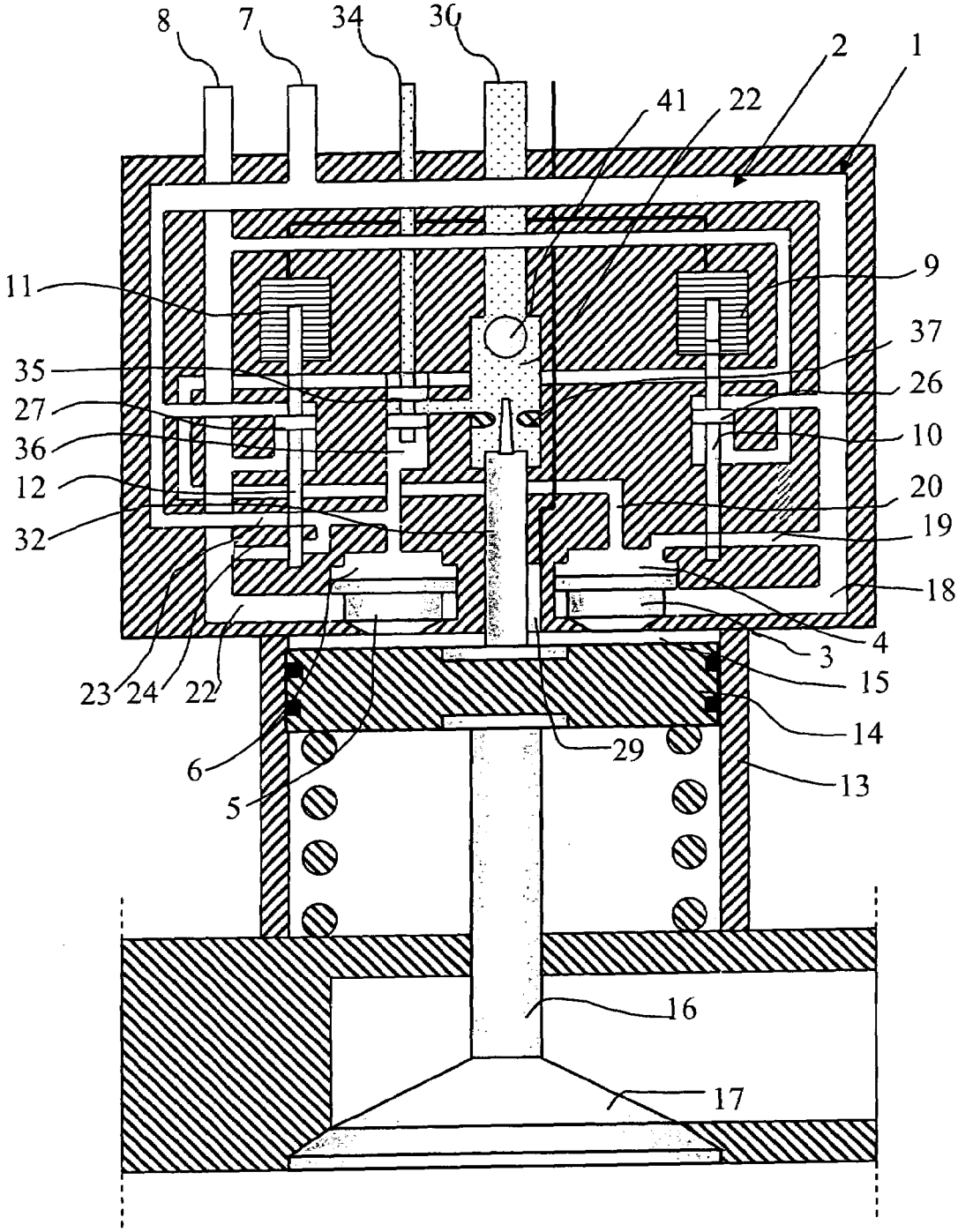
FIG. 7 shows a second embodiment of the device according to the invention, in a first stage, with the circuit shown in FIG. 6 included.
Figure 8:
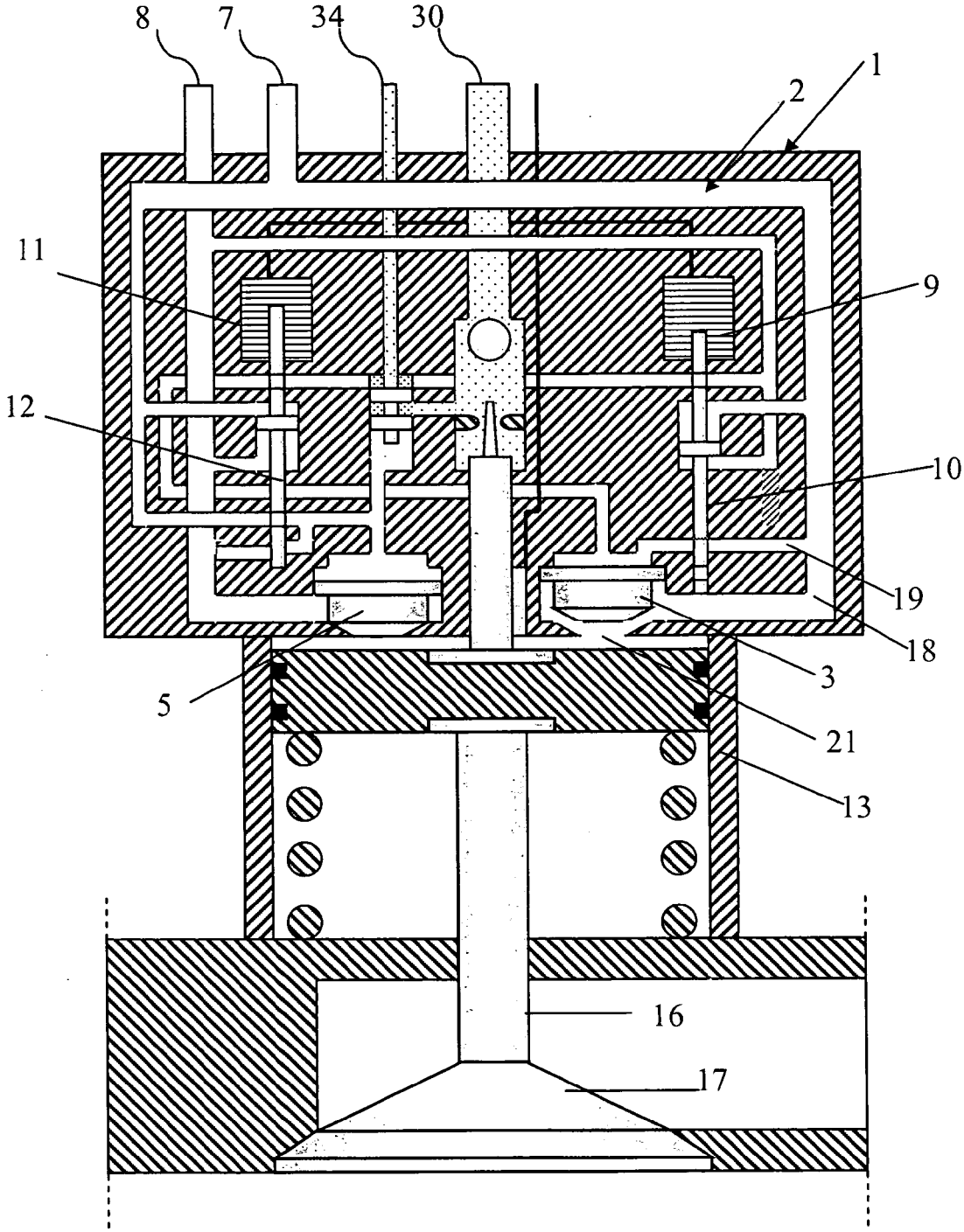
FIG. 8 shows the device according to FIG. 7, in a second stage.

In FIG. 5 the device is shown in a subsequence stage, after the deactivation of the second electro magnet 11 and the displacement of the valve body 12 associated thereto through the action of the associated spring element 27 to a position in which the second chamber 6 once again communicates with the pressure fluid depression 8 through the fifth branch 24. The valve body 5 located in the second chamber 6 has, by the pressure from the fluid in the chamber 15, been displaced away from the opening 25, and pressure fluid is permitted to flow out from the chamber 15 through the third branch 22 to the pressure fluid depression 8 while the actuator piston 14 and the valve 17 connected thereto are displaced towards the home position.

It should be noted that the slave valve 35 has been displaced to its opening position and, thus, does not any longer lock the valve 17 in its remote position, since the seventh branch 36 is now communicating with the pressure fluid depression 8 through the fifth branch 24.

When the pressure in the chamber 15 has been reduced to such a degree that the valve has reached its home position, the second valve body is closed due to the effect of the gravitational force and/or its upper side once again being brought into communication with the pressure fluid source before the next cycle. Thereby, a return to the starting position of FIG. 1 is achieved.

It should be realized, as also has been shown in the drawings, that each of the valve bodies 10, 12 may comprise a plurality of openings or passages for the accomplishment of a communication in the conduits and branches in question in accordance with the teaching of the application in general.

It should be realized that the electro magnets used may be a pushing type or pulling type of magnets.

In the case in which the device is used for accomplishing a variable compression ratio, the valve 17 should be replaced by a corresponding piston in such a device. The piston is then arranged in a cylinder that directly communicates with the combustion chamber. Also in the case when the device forms an injection valve, the valve 17 should be replaced by a piston.

The device may also be used for the expansion of gases, whereby the gas/air pulses that are created can be used in air motors, and in general for the transmission of gas pulses into mechanical movement.

A particular advantage of the invention is that it uses a minimum number of electro magnets and valve bodies associated thereto for the opening/interruption of the described conduits and branches in the pressure fluid circuit 2. Accordingly, one electro magnet 9 is used for the opening/closure of the second branch 19 and the conduit 20 through a displacement of the valve body 10 associated thereto. A further electro magnet 11 is used for the opening/closure of the forth and fifth branch 23, 24 and of the conduit 20 and the sixth branch 28 through the displacement of the valve body 12 associated thereto.

The invention claimed is:

1. A method for controlling a pressure fluid flow in a pressure pulse generator, comprising a pressure fluid circuit (2) that, at a first end thereof, is connected with a pressure fluid source (7) and, at a second end thereof, is connected with a pressure fluid depression (8), a first branch (18) and a second branch (19) of the circuit (2), said branches leading from the pressure fluid source (7) to opposite sides of a valve body (3) that is displacebly located in a chamber (4), said chamber (4) having an opening (21) on one side of the valve body (3), said opening (21) communicating with the first branch (18) and permitting pressure fluid to flow out of the chamber (4), and wherein the valve body (3), under the action of the pressure fluid in the branches (18, 19), is displaced to a first position in which it closes the opening (21) or to a second position, in which it leaves the opening (21) open for out-flow of the pressure fluid, characterized in that, during a first stage, for the purpose of accomplishing a pressure pulse departing from the opening (21), the valve body is displaced by letting the pressure fluid source (7) communicate with said chamber (4) through the first branch (18) while, simultaneously, the communication between the chamber (4) and the pressure fluid source (7) through the second branch (19) is interrupted.

2. A method according to claim 1, characterized in that, during a second stage, for the purpose of interrupting the pressure fluid pulse, the pressure fluid source (7) is permitted to communicate with the second chamber (4) through the second branch (19).

3. A method according to claim 1, characterized in that said chamber, through a conduit (20), is connected with the pressure fluid depression (8) and that the chamber (4) is permitted to communicate with the pressure fluid depression (8) through the conduit (20) during the first stage, and that the communication between the chamber (4) and the pressure fluid depression (8) is permanently interrupted during a second stage.

4. A method according to claim 1, characterized in that the pressure fluid circuit comprises a third branch (22) and a fourth branch (23) of the circuit (2), said branches leading to opposite sides of a second valve body (5) that is displaceably located in a second chamber (6), wherein the chamber (6), on one side of the valve body (5), has an opening (25) that communicates with the third branch (22) and through which pressure fluid can flow into or out of the chamber, and by which the valve body (5), through a displacement, under the action of the pressure fluid in the branches, is displaced to a first position in which it closes the opening (25) or to second position in which leaves the opening (25) open for in-flow or out-flow of the pressure fluid and wherein the second chamber (6) is brought to a permanent communication with the pressure fluid source (7) through the fourth branch (23) during the first stage.

5. A method according to claim 4, characterized in that the communication between the second chamber (6) and the pressure fluid source (7) through the fourth branch (23) is interrupted during or in connection to a second stage and before a subsequent first stage.

6. A method according to claim 4, characterized in that the second chamber (6), through the third branch (22), is brought into communication with the pressure fluid depression (8) when the communication between the second chamber (6) and the pressure fluid source (7) through the fourth branch is interrupted.

7. A method according to claim 4, characterized in that the pressure fluid circuit comprises a fifth branch (24) that leads from the pressure fluid depression (8) to the second chamber (6) on the same side of the second valve body (5) as the fourth branch (23), and that the second chamber (6) is brought into communication with the pressure fluid depression (8) through the fifth branch (24) when the communication between the second chamber (6) and the pressure fluid source (7) is interrupted.

8. A method according to claim 4, characterized in that the openings (21, 25) lead to a cylinder space (15) on one side of a piston (14) movably arranged in said space, said piston (14) being connected with an inlet or outlet valve (17) of a combustion engine or with a fuel injection valve to the combustion chamber of a combustion engine, or is connected to or forms a piston in a cylinder that is connected with the combustion chamber for the purpose of accomplishing a variable compression ratio therein, and that the position of the valve (17) or the variable compression piston in relation to a cylinder of the combustion engine is controlled by means of pressure fluid pulses delivered through said openings (21, 25).

9. A method according to claim 8, characterized in that permission of communication and interruption of communication in the circuit is performed by means of valve bodies (10, 12) that are electro magnetically controlled and arranged in the circuit, and through an activation of the electro magnets (9, 11) associated thereto.

10. A method according to claim 9, characterized in that the position of a piston in the cylinder of the combustion engine is registered by means of a sensor, and that the communication and the interruption of the communication in the circuit is performed on basis of the registered position of the piston.

11. A method according to claim 3, characterized in that the first chamber (4) is permitted to communicate with the pressure fluid source (7) through a third branch (28) when the communication between the first chamber (4) and the pressure fluid source (7) through the second branch (19) is interrupted or has been interrupted, and that the communication through the third branch (28) is interrupted when the first chamber (4), during the first stage, is permitted to communicate with the pressure fluid depression (8) through said conduit (20).

12. A device for generating pressure pulses, comprising a pressure fluid source (7) and a pressure fluid depression (8), a pressure fluid circuit (2), a valve body (3) displaceably located in a chamber (4), a first branch (18) and a second branch (19) of the circuit (2), said branches leading to opposite sides of the valve body (3), the chamber (4) having an opening (21) on one side of the valve body (3), said opening (21) communicating with the first branch (18) and permitting pressure fluid to flow out of the chamber (4), wherein the valve body (3), under the action of the pressure fluid in the branches (18, 19), is displaceable to a first position in which it closes the opening (21) and to a second position in which it leaves the opening (21) open for out-flow of the pressure fluid, characterized in that it comprises a first valve member (9, 10) which is arranged to open or interrupt the communication between the chamber (4) and the pressure fluid source (7) through the second branch (19) upstream said chamber (4).

13. A device according to claim 12, characterized in that it comprises a conduit (20) that leads from the side of the chamber (4) that communicates with the second branch (19) to the pressure fluid depression (8), and a second valve member (9, 10) which is arranged to open or interrupt the communication between the chamber (4) and the pressure fluid depression (8) via said conduit (20).

14. A device according to claim 13, characterized in that said conduit (20) and the second branch (19) are arranged at least partly in parallel or beside each other and that the first and second valve members are formed by one and the same body (9, 10).

15. A device according to claim 13, characterized in that it comprises a third valve member that is arranged to open or interrupt the communication between the first chamber (4) and the pressure fluid depression (8) through said conduit (20).

16. A device according to claim 12, characterized in that it comprises a second valve body (5) that is displaceably arranged in a second chamber (6), a third branch (22) and a fourth branch (23) of the circuit, said branches leading to opposite sides of the second valve body (5) in the second chamber (6), wherein the second chamber (6), on one side of the valve body (5), has an opening (25) that communicates with the third branch (22) and through which pressure fluid can flow into or out of this second chamber (6), and wherein the valve body (5), under the action of the pressure fluid in the branches (22, 23), is displaceable to a first position in which it closes the opening (25) or to a second position in which it leaves the opening (25) open for in-flow or outflow of the pressure fluid, and wherein the third branch (22) extends from the second chamber (6) to the pressure fluid depression (8), and the fourth branch (23) extends from the second chamber (6) to the pressure fluid source (7), and a second valve member (11, 12) for the opening or interruption of the communication between the second chamber (6) and the pressure fluid source (7) through the fourth branch (23).

17. A device according to claim 16, characterized in that the pressure fluid circuit comprises a fifth branch (24) that leads from the pressure fluid depression (8) to the second chamber (6) on the same side of the second valve body (5) as the fourth branch (23), and a third valve member (11, 12) that is arranged to permit the second chamber (6) to communicate with the pressure fluid depression (8) through the fifth branch (24) when the communication between the second chamber (6) and the pressure fluid source (7) through the fourth branch (23) is interrupted.

18. A device according to claim 17, characterized in that the fourth and fifth branches (23, 24) are arranged at least partly in parallel or beside each other, and that the second and third valve members are formed by one and the same body (11, 12).

19. A device according to claim 17, characterized in that the conduit (20) that leads from the first chamber (4) to the pressure fluid depression (8) is arranged partly in parallel with or beside the fifth branch (24) and that the second and third valve members are formed by one and the same body (11, 12).

20. A device according to claim 17, characterized in that the second and third valve members are formed by one and the same body (11, 12), said body being arranged to perform a movement simultaneously in said conduit (20) and in the fourth and fifth branches (23, 24).

21. A device according to claim 17, characterized in that the surface of at least one of the first valve body (3) and the second valve body (5) that is directed towards the opening (21, 25) associated to the body in question and exposed to the pressure fluid in said branches is smaller than the corresponding surface on the opposite side of the valve body.

22. A device according to claim 16, characterized in that the openings (21, 25) of the first chamber (4) and the second chamber (6) opens in a cylinder space (15) at one side of a moveable piston (14) arranged in said space, said piston being connected with an inlet or outlet valve (17) of a combustion engine or a fuel injection valve to the combustion chamber of a combustion engine, or being connected with or forming part of a piston arranged in a cylinder that is connected with the combustion chamber for the purpose of accom-plishing a variable compression ratio in the latter, and that the position of the valve or the variable compression piston respectively in relation to a cylinder of the combustion engine is controlled by means of pressure fluid pulses delivered through said openings (21, 25).

23. A device according to claim 12, characterized in that the valve member or at least one of the valve members comprises a valve body (10, 12) driven by an electro magnet.

24. A device according to claim 17, characterized in that the fourth and fifth branches (23, 24) communicate with a pressure fluid controlled slave valve (35) for permitting and interrupting a flow of liquid from a device for hydraulic braking and/or locking of the piston (14).

25. A device according to claim 17, characterized in that it comprises a sixth branch (28), through which the first chamber (4), communicates with the pressure fluid source (7), and a fourth valve member (11, 12) for permitting and interrupting the communication between the first chamber and the pressure fluid source (7) through the sixth branch (28).

26. A method according to claim 1, characterized in that permission of communication and interruption of communication in the circuit is performed by means of valve bodies (10, 12) that are electro magnetically controlled and arranged in the circuit, and through an activation of the electro magnets (9, 11) associated thereto.

* * * * *